United States Patent [19]

Jones

[11] Patent Number: 4,785,590

[45] Date of Patent: Nov. 22, 1988

[54] ENCLOSURE WITH TELESCOPING WALLS

[76] Inventor: Paul R. Jones, 518 Grand Ave., Cincinnati, Ohio 45205

[21] Appl. No.: 61,193

[22] Filed: Jun. 11, 1987

[51] Int. Cl.[4] ..... E04B 1/346

[52] U.S. Cl. ..... 52/64; 52/67; 160/222

[58] Field of Search ..... 52/64, 67; 44/126; 160/32, 33, 34, 197, 202, 20, 31, 222

[56] References Cited

U.S. PATENT DOCUMENTS

| | | | |
|---|---|---|---|
| 337,180 | 3/1886 | McCoy . | |
| 844,220 | 2/1907 | Westbrooke | 135/90 |
| 888,433 | 5/1908 | Thompson . | |
| 1,143,846 | 6/1915 | Manuel . | |
| 1,500,266 | 7/1924 | Primm, Sr. . | |
| 1,801,247 | 4/1931 | Rush | 135/90 |
| 1,927,982 | 9/1933 | Howard . | |
| 2,975,873 | 3/1961 | Beliveau et al. . | |
| 3,698,465 | 10/1972 | Aberg | 160/202 X |
| 3,832,810 | 9/1974 | Johnston | 52/67 |
| 3,844,063 | 10/1974 | Jackson . | |

*Primary Examiner*—Carl D. Friedman

*Attorney, Agent, or Firm*—Wood, Herron & Evans

[57] ABSTRACT

An enclosure for use as a garage, storage shed and the like comprises a roof supported at its four corners by vertical posts, and front, back and opposed side walls each including a plurality of telescoping wall panels movable between a raised position in which the wall panels are nested together near the roof and a lowered position wherein the wall panels extend between the roof and ground. A cable and pulley system is operable to raise and lower all four walls simultaneously to provide access to the interior of the enclosure from any point along the perimeter of the enclosure.

5 Claims, 5 Drawing Sheets

10
12
13
14
16
18
20
22
26
28
4
7
56
60
62
64
66
68
70
72
74
76
92
94
96
98
100
102
104
106

ENCLOSURE WITH TELESCOPING WALLS

FIELD OF THE INVENTION

This invention relates to enclosures such as sheds, garages and the like, and, more particularly, to an enclosure having telescoping front, back and opposed side walls which are simultaneously movable between a retracted and extended position.

BACKGROUND OF THE INVENTION

Enclosures such as sheds, huts and the like have been provided in which the front wall, back wall and opposed side walls are all raised and lowered simultaneously. These structures have been utilized to dry bricks, house animals or in other applications wherein it is desirable to provide complete ventilation to the interior of the enclosure and/or to provide access to the interior from any location around the perimeter of the enclosure. See, for example, U.S. Pat. Nos. 337,180 to McCoy; 1,500,266 to Primm, Sr. and 3,844,063 to Jackson.

Enclosures of the type disclosed in the patents mentioned above comprise a roof structure supported at its four corners by posts extending to ground level, and front, back and opposed side walls all hinged to the roof. A cable and pulley system is provided to pivot each wall about its hinged connection to the roof so that the walls can be raised to expose the interior of the enclosure or lowered to completely close the interior. The pulley system is constructed so that operation of a hand or motorized crank acts upon cables connected to each of the walls so that they are raised or lowered simultaneously.

The structures disclosed in the patents to McCoy, Primm, Sr. and Jackson, while advantageous in some respects, also have disadvantages. Movement of the walls between the lowered and raised positions requires the walls to pivot about their hinged connection to the roof and swing upwardly or downwardly. This arrangement requires a substantial amount of room to allow the walls to swing unobstructed as they are being raised or lowered, and space considerations in some applications may not permit such a construction.

Additionally, once the walls are moved to the raised position, all of the weight of the walls are carried by the cables and hinges. This places a substantial load on the hinges which are subject to failure if they become oxidized and weakened by the weather. In the event of a failure of either of the hinge or cable, the walls present a substantial hazard if they should fall from their raised position near the roof and strike an individual or object beneath.

SUMMARY OF THE INVENTION

It is therefore among the objectives of this invention to provide an enclosure for use as a garage, storage shed, hut or the like in which all four walls are simultaneously raised and lowered in a minimum amount of space, which is weather resistant, which is resistant to failure and which presents minimal hazard to persons or things in the area of the enclosure.

These objectives are accomplished in an enclosure which comprises a roof supported at its four corners by vertical posts resting on or embedded in the ground, and a front wall, back wall and opposed side walls, each mounted to the roof. Each wall is formed of a plurality of telescoping wall panels vertically movable between a retracted position in which the wall panels nest together in a compact unit near the roof, and an extended position wherein the wall panels extend from the roof to the ground. A motor operated cable and pulley system, completely protected from the weather by the roof and walls, is effective to simultaneously raise and lower all four walls as a unit to permit access to the entire interior of the enclosure or to completely close the interior.

In a presently preferred embodiment, each wall panel forming the four walls of the enclosure comprises a top, opposed sides connected at one end to the top and a pair of U-shaped channels each connected to the opposite end of one of the side sections. A hanger having a hook at each end is fixedly mounted to the top of each wall panel.

The wall panels forming each wall of the enclosure include a top wall panel fixedly mounted to the roof of the enclosure, a bottom wall panel and a plurality of intermediate wall panels between the top and bottom wall panels. The width dimension of the wall panels progressively increases from the bottom wall panel to the top wall panel so that the wall panels can nest together as they are moved to a raised position toward the roof of the enclosure.

In an extended position, successive wall panels are supported and hand downwardly from the wall panel immediately above. Beginning at the roof of the enclosure, the opposed U-shaped channels of the top wall panel receive and support the hooks at the ends of the hanger mounted to the next wall panel immediately beneath. In turn, the channels of that next wall panel receive the hooks at the ends of the hanger of the intermediate wall panel below and this continues in succession to the bottom wall panel. The hooks of the hangers, and channels at the sides of the wall panel, provide a secure means of attachment and limits side-to-side movement between adjoining wall panels.

The cable and pulley system for lifting the walls of the enclosure comprises four individual cables connected by pulleys to a motor driven spool or reel. Two of the cables are mounted at opposite ends to the bottom wall panel of one side wall, and the other two cables are mounted at opposite ends to the bottom wall panel of the opposite side wall. Each of the wall panels forming the front and back walls are secured at their ends to the corresponding wall panels of the side walls for movement of the front and back walls with the side walls.

In response to operation of the motor, the cables begin raising the walls by first vertically lifting the bottom wall panel of each side wall and the bottom wall panels of the front and back walls attached thereto. As the bottom wall panel is lifted upwardly, the hooks at the ends of its hanger disengage the channels of the intermediate wall panel immediately above. The sides of the bottom wall panel slide along plastic guides mounted to the U-shaped channels of the intermediate wall panel above as it moves into such intermediate wall panel which avoids binding therebetween. When the hanger and top of the bottom wall panel engage the top of the intermediate wall panel immediately above, such intermediate wall panel is lifted upwardly with the bottom wall panel and the hooks at the ends of its hanger disengage the U-shaped channel of the next intermediate wall panel. In this manner, the wall panels nest together as they are lifted upwardly and form a compact unit at the roof of the enclosure. This procedure is reversed when the motor is operated to lower the wall panels back toward the ground.

In a presently preferred embodiment, a plurality of hangers are spaced along the length of the top of each wall panel in order to insure that the wall panels are securely supported one upon the other. Additionally, a plurality of plastic guides are mounted to the U-shaped channels of each wall panel, between the spaced hangers, so that the wall panels smoothly slide relative to one another upon raising and lowering of each wall.

The telescoping walls of the enclosure herein are raised and lowered in a vertical plane which eliminates the need for additional space as required by the hinged walls of the prior art discussed above. The pulleys, cables and motor are all covered by the roof and/or walls of the enclosure herein which avoids any problems of damage due to weathering or the like. In addition, the provision of two cables on each of the side walls, and a fixed connection between the front and rear walls and side walls, substantially reduces the chance of any of the walls falling and creating a hazard to individuals or objects near the enclosure.

DETAILED DESCRIPTION OF THE DRAWINGS

The structure, operation and advantages of the presently preferred embodiment of this invention will become further apparent upon consideration of the following description, taken in conjunction with the accompanying drawings, wherein:

FIG. 1 is a side view of the enclosure herein with the walls in a lowered position;

FIG. 2 an end view of the enclosure shown in FIG. 1;

Figure 1:
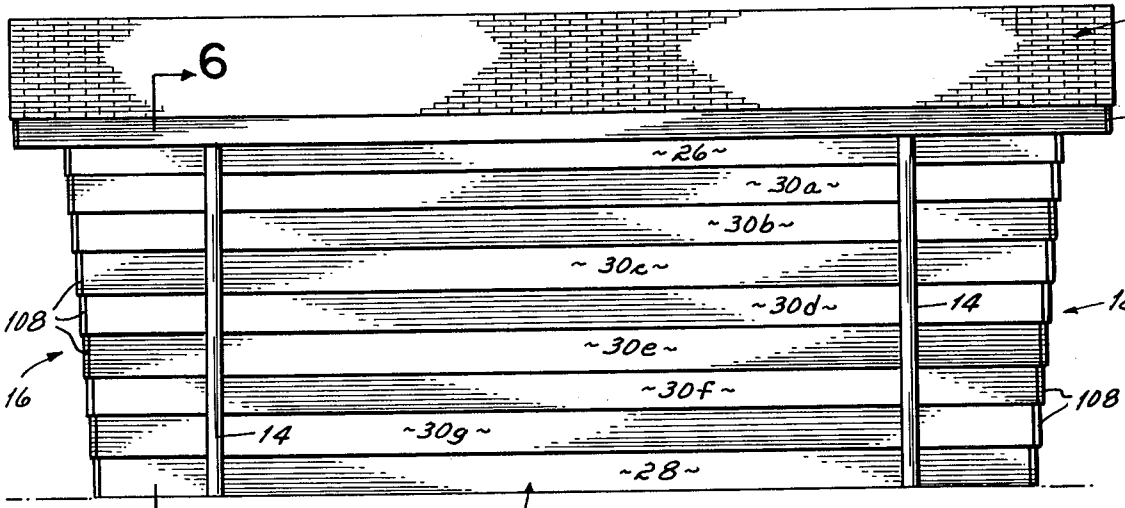
Figures 3, 4:
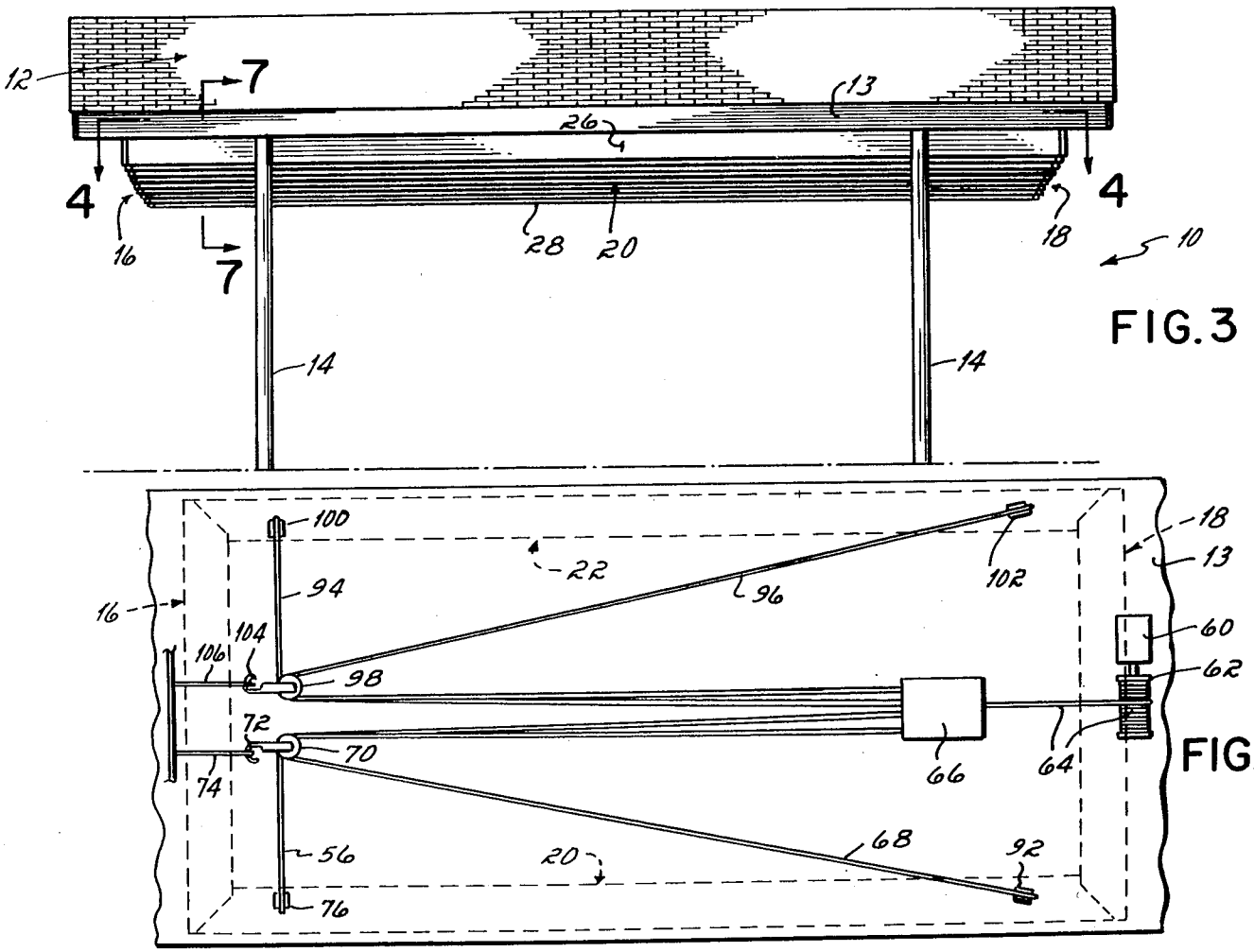
FIG. 3 is a view similar to FIG. 1 except with the walls in a raised position.
FIG. 4 is a plan view of the cable and pulley system for raising and lowering the walls taken generally along line 4—4 of FIG. 3.
Figure 7:
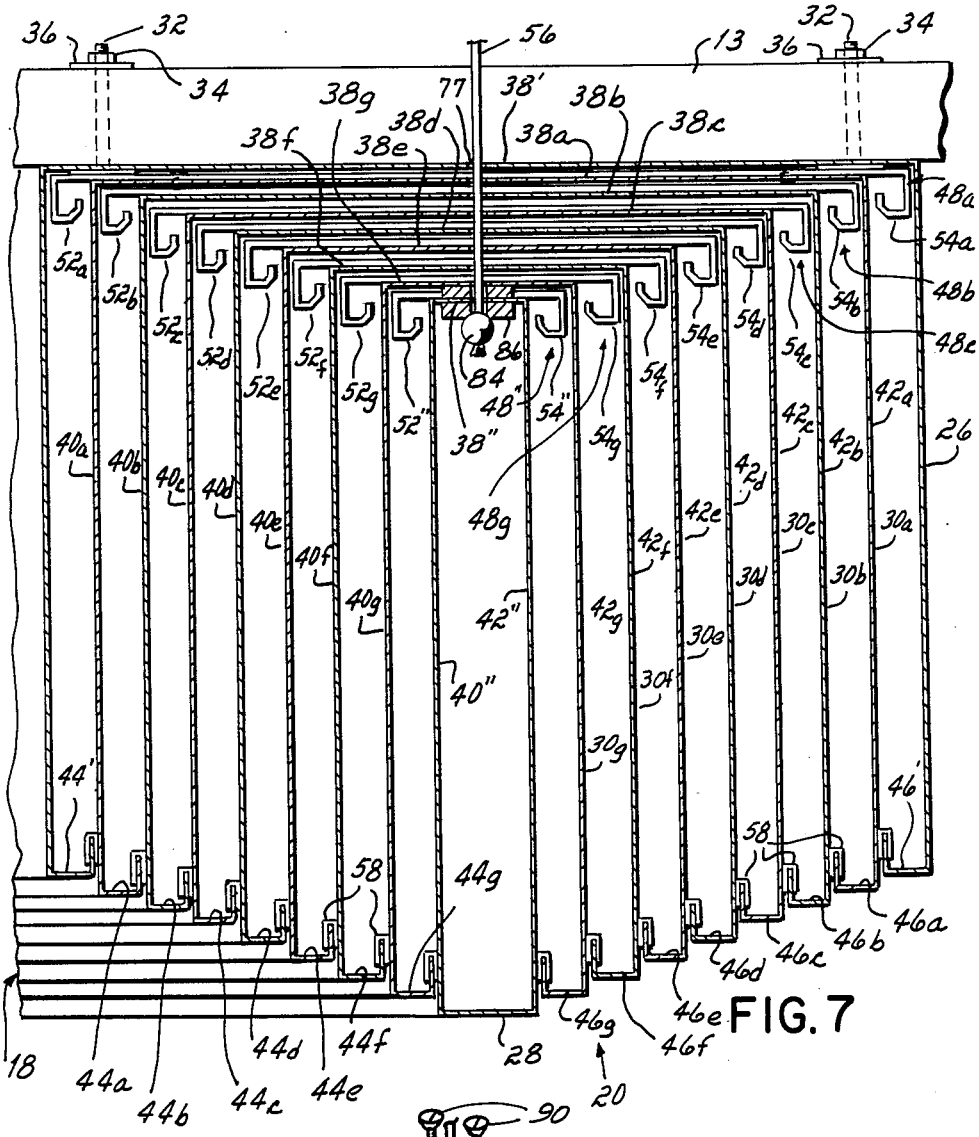
Figure 6:
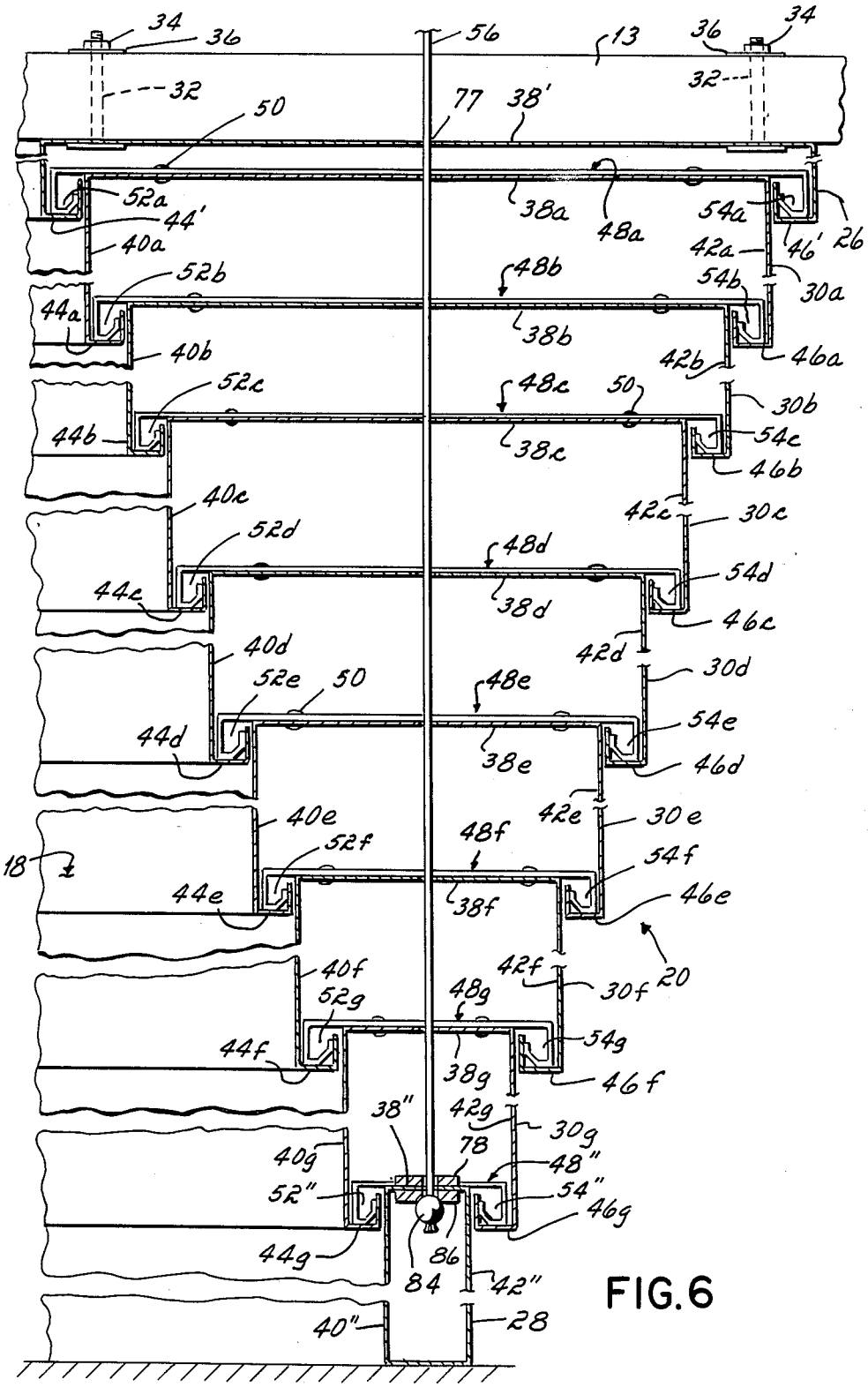
Figure 8:
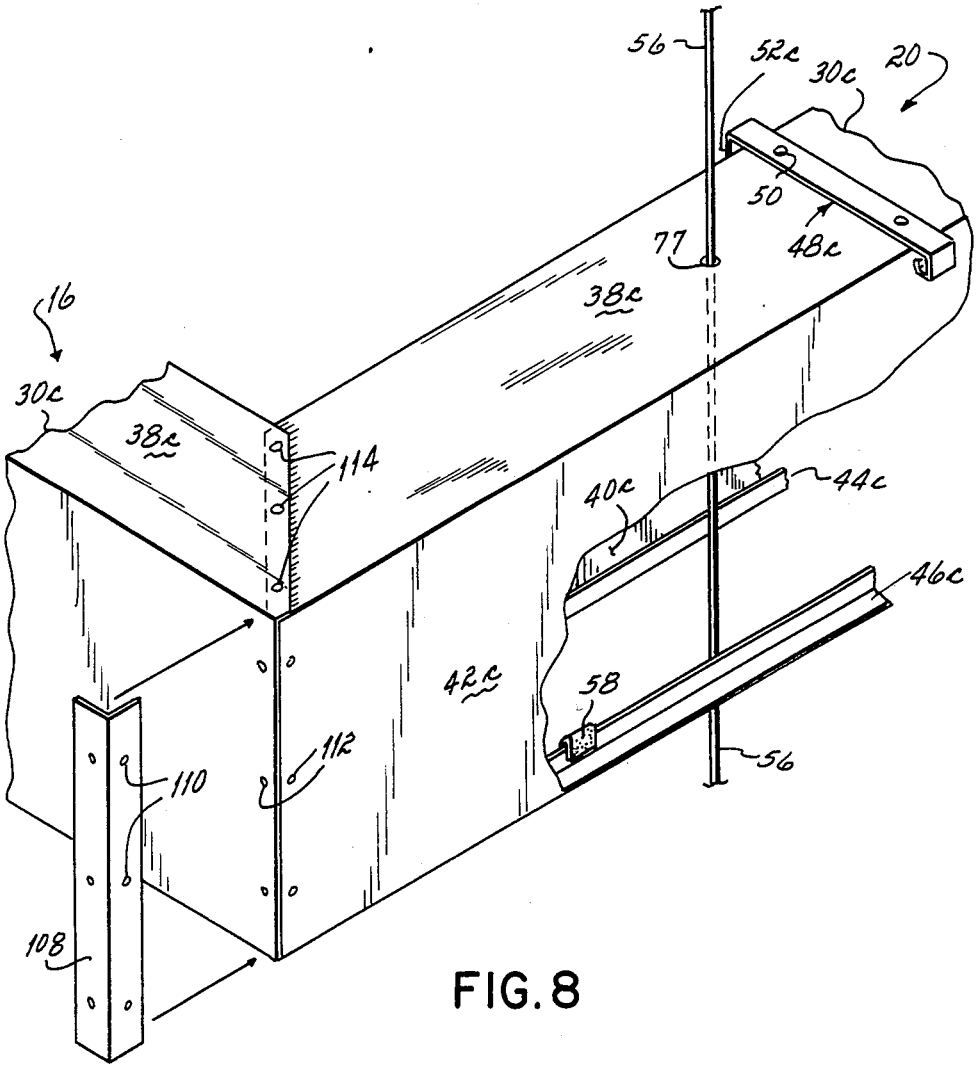

FIG. 6 a cross-sectional view, showing a portion of the length of the wall panels in an extended position, taken generally along 6—6 of FIG. 1;

FIG. 7 is a view similar to FIG. 6 with the wall panels in a retracted position which is taken generally along line 7—7 of FIG. 3; and FIG. 8 is a perspective view of a portion of the adjoining wall panels of a side wall and an end wall showing the corner construction therebetween.

DETAILED DESCRIPTION OF THE INVENTION

Figure 2:
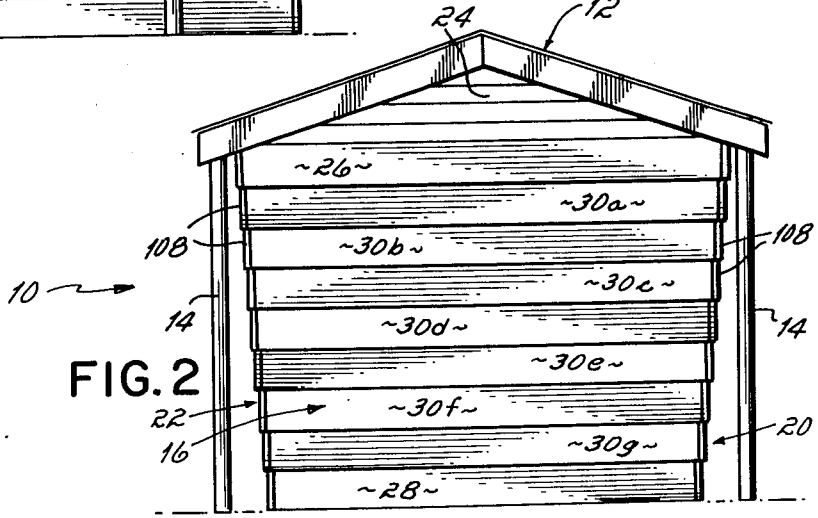

Referring now to FIGS. 1–3, the enclosure 10 comprises a roof 12 supported at each corner by vertical posts 14 and having a front wall 16, back wall 18 and opposed side walls 20, 22. It is contemplated that the vertical posts 14 would be permanently mounted in the ground or atop concrete pads or the like to provide a secure support for the roof 12 and walls 16–22. Preferably, the roof 12 is constructed of trusses resting on a perimeter plate 13 which are covered by plywood or fiberboard and then shingles. The gable ends of the roof 12, one of which is illustrated in FIG. 2, are covered by siding 24 of any desired type. The details of the roof construction form no part of this invention per se and are therefore not illustrated in detail.

Referring now to FIGS. 6–8, the detailed structure of side wall 20 is illustrated, it being understood that all of the other walls are constructed in the identical manner. Side wall 20 is formed of a number of telescoping wall panels including a top wall panel 26, a bottom wall panel 28, and, in the embodiment illustrated in the figures, six intermediate wall panels 30*a*–*g*. The top wall panel 26 is permanently mounted to the perimeter plate 13 of roof 12 by lag bolts 32 each secured by a nut 34 and washer 36. As discussed in detail below, the remaining wall panels hang downwardly from the roof 12 to the ground and are supported upon one another in a manner to permit nesting or telescoping of the wall panels together to form a compact unit.

The structure of each wall panel is the same except for width dimension and reference is made to intermediate wall panel 30*c* shown in FIGS. 6, 7 and 8 for purposes of discussion. The same reference numbers used to identify the structure of wall panel 30*c* are used to refer to the common structure of each wall panel. Wall panel 30*c* comprises a top 38*c* which is connected at its ends to an inner side 40*c* and an outer side 42*c*. The sides 40*c*, 42*c* extend downwardly at a right angle from the top section 38*c* parallel to one another. The inner side 40*c* terminates in a U-shaped inner channel 44*c*, and the outer side 42*c* terminates in a U-shaped outer channel 46*c* spaced from inner channel 44*c*.

A plurality of hangers 48*c* are mounted by bolts or rivets 50 at spaced intervals along the length of the top 38*c* of intermediate wall panel 30*c*, one of which is shown in FIGS. 6 and 8. The hanger 48*c* is formed with an inner hook 52*c* at one end and an outer hook 54*c* at the opposite end. As shown in FIG. 6, the inner hook 52*c* of wall panel 30*c* is formed to seat within the inner channel 44*b* of the intermediate wall panel 30*b* immediately above wall panel 30*c*. *Similarly, the hook 54c* at the opposite end of hanger 48*c* is formed to seat within the outer channel 46*b* of wall panel of 30*b*.

As best shown in the extended position of side wall 20 in FIG. 6, the width of the tops 38 of the wall panels 26–30*a*–*g* progressively decreases in moving from the top wall panel 26 downwardly to the bottom wall panel 28. The structure for supporting adjacent wall panels comprises the inner and outer hooks 52, 54 of one wall panel and the U-shaped inner and outer channels 44, 46 of the wall panel immediately above. For example, the inner and outer hook sections 52*a*, 54*a* of hanger 48*a* support the wall panel 30*a* within the inner and outer channels 44', 46', respectively, of the top wall panel 26. Intermediate wall panel 30*b* is supported and hangs downwardly from wall panel 30*a* in the same manner. This is continued with each intermediate wall panel 30*a*–*g* down to the bottom wall panel 28 as illustrated in FIG. 6.

Nesting of adjacent wall panels with one another is illustrated in FIGS. 3 and 7. In response to upward movement of cable 56, as discussed in detail below, the bottom wall panel 28 begins to move upwardly toward the roof 12. As the bottom wall panel 28 moves upwardly, the hook sections 52'', 54'' at the end of its hanger 48'' disengage the inner and outer channels 44*g*, 46*g*, respectively, of the intermediate wall panel 30*g* immediately above. The space between the inner and outer channels 44*g*, 46*g* of intermediate wall panel 30*g* permits the side 40'', 42'' of bottom wall panel 28 to pass therebetween.

As shown in FIGS. 7 and 8, plastic guides 58, only one of which is shown, are mounted along the length of the inner and outer channels 44, 46 of each wall panel 26, 28, 30*a–g* to avoid binding between the sides of the wall panels and the channels along which they slide. The guides 58 also provide stability to limit inward and outward lateral movement of one wall panel relative to another, particularly with the walls 16–22 in an extended position.

The bottom wall panel 28 continues its upward movement so that its hanger 48" and top 38" engage the top 38*g* of intermediate wall panel 30*g*. The bottom wall panel 28 and intermediate wall panel 30*g* thereafter move upwardly as a unit with the bottom wall panel 28 nested within the intermediate wall panel 30*g*. The inner and outer hooks 52*g*, 54*g* of intermediate wall panel 30*g* disengage the inner and outer channels 44*f*, 46*f* of the next intermediate wall panel 30*f* as the bottom wall panel 28 and intermediate wall panel 30*g* move upwardly. This process continues as all of the wall panels are moved upwardly with their hangers 48 disengaging the channels 44, 46 of the wall panel above, until all of the wall panels are nested together in a compact unit at the roof 12 as illustrated in FIG. 7. The procedure is reversed when the cable 56 is moved in the opposite direction Referring now to FIGS. 4, 5 and 8, the construction of the cable and pulley system for raising and lowering the wall panels is illustrated in more detail. A reversible motor 60, mounted to the roof plate 13, is connected to a spool or reel 62 and is operable to rotate the reel 62 in a clockwise and counterclockwise direction. The reel 62 is connected by a main cable 64 to a junction block 66. The first cable 56 and a second cable 68 extend from the junction block 66 to a double groove pulley 70 which is mounted near the front wall 16 of the enclosure 10 by a hook 72 connected to an eyebolt 74. The first cable 56 extends from the pulley 70 to a single groove pulley 76 mounted to the roof plate 13 directly above one end of the side wall 20. The first cable 56 passes through a bore 77 formed in the center of each of the wall panels 26, 28 and 30*a–g* of side wall 20, and then terminates at the top 38" of the bottom wall panel 28.

Figure 5:
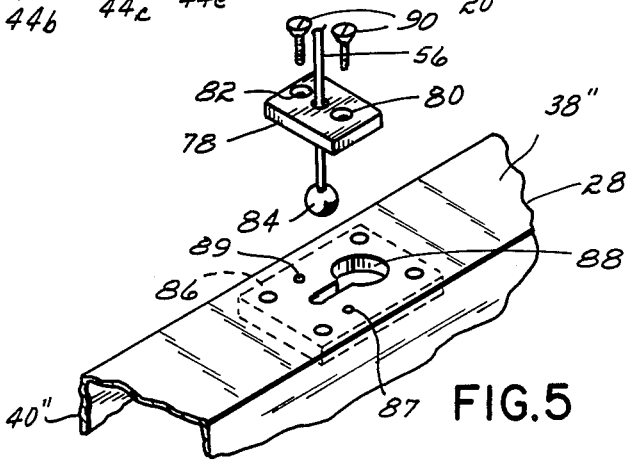
FIG. 5 is an enlarged, exploded view of the connection between a cable and bottom wall panel of each wall.

As shown in FIG. 5, the end of first cable 56 which extends to the bottom wall panel 28 passes through a plate 78 having screw holes 80, 82. A ball 84 is affixed to such terminal end of cable 56. A plate 86 formed with a keyhole slot 88 is affixed to the top 38" of bottom wall panel 28 in alignment with the plate 78. The first cable 56 is secured to the bottom wall panel 28 by inserting the ball 84 within the keyhole slot 88 and then threading screws 90 through the holes 80, 82 in plate 78 into aligning holes 87, 89 formed in plate 86.

The second cable 68 extends from the double groove pulley 70 to the opposite end of side wall 20 where a single groove pulley 92 is mounted directly over the side wall 20. The second cable 68 passes downwardly through the side wall 20, and is connected to the bottom wall panel 28, in the same manner as first cable 56 described above.

The side wall 22 is provided with the same arrangement of cables as side wall 20. A third and fourth cable 94, 96, respectively, are connected at one end to the junction block 66 and extend through a double groove pulley 98 which is attached to the roof plate 13 near the front wall 16 by a hook 104 and eyebolt 106. The cables 84, 96 continue from pulley 98 to a pair of single groove pulleys 100, 102 mounted at opposite ends of the side wall 22. The terminal ends of third and fourth cables 94, 96 are connected to the bottom wall panel 28 of side wall 22 in the identical fashion as first and second cables 56, 68.

The motor 60 is operable to rotate the reel 62 to either wind the main cable 64 upon the reel 62 or unwind the main cable 64. When the reel 62 is rotated to wind the main cable 64 thereon, the junction block 66 is moved laterally toward the reel 62, which, in turn, pulls all of the cables upwardly to raise side walls 20, 22. The side walls 20, 22 are lowered by reversing the direction of motor 60 and unwinding the main cable 64 from reel 62.

As illustrated in FIGS. 4 and 8, only the side walls 20, 22 are provided with cables to raise and lower their wall panels. In order to simultaneously raise and lower the front wall 16 and back wall 18, structure is provided to permanently mount the front and back walls 16, 18 to the side walls 20, 22. The corner construction illustrated in FIG. 8 is provided for this purpose.

A corner plate 108 is fitted over the abutting ends of, for example, the intermediate wall panel 30*c* of front wall 16 and the corresponding intermediate wall panel 30*c* of side wall 20. Rivets, bolts or other essentially permanent means of fixation (not shown) are inserted through the holes 110 in corner plate 108 into the aligning holes 112 in the intermediate wall panels 30*c* of both the front and side walls 16, 20. Additionally, a portion of the top 38*c* of front wall 16 is allowed to overlap a portion of the top 38*c* of the intermediate wall panel 30*c* of side wall 20. These overlapping portions of tops 30*c* are connected by rivets or bolts 114 to further secure the front wall 16 to the side wall 20. The corner plate 108 and overlapping tops of adjoining wall panels also provide a finished appearance to the enclosures 10 to improve its overall aesthetics. The same corner and overlapping top construction is utilized to connect the opposite end of side wall 20 to the back wall 18, and to connect the front and back walls 16, 18 to the side wall 22. Hence, raising of the side walls 20, 22 as described above is effective to raise the front and back walls 16, 18 simultaneously.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, it is contemplated that essentially any number of wall panels could be employed to form the walls herein depending upon the desired dimensions of the enclosure. Additionally, the cable and pulley system could be modified without departing from the scope of the invention to simultaneously raise and lower the walls.

Therefore, it is intended that the invention not be limited to the best mode contemplated for carrying out this invention, but that the invention will include all embodiments falling within the scope of the appended claims.

I claim:

1. An enclosure comprising:

a roof having four corners;

vertical supports mounted to each corner of said roof for supporting said roof above the ground;

a front wall, a back wall and opposed side walls each mounted to said roof, each of said walls including a plurality of vertically oriented, telescoping wall panels comprising:.

(i) a planar top;

(ii) opposed sides connected at each end of said planar top and extending outwardly therefrom;

(iii) a U-shaped channel connected to each of said opposed sides;

(iv) a hanger mounted to said planar top, said hanger being formed with hooks at opposite ends, said hooks of said hanger of one wall panel being formed to seat within said U-shaped channels of an adjacent wall panel so that said one wall panel is supported upon and hangs downwardly from said adjacent wall panel;

said wall panels of said front and rear walls being formed with opposed ends which abut an end of said wall panels of each said side walls;

mounting means for mounting said ends of each of said wall panels of said front and rear walls to said abutting ends of said wall panels of said opposed side walls;

means connected to said opposed side walls for simultaneously moving said wall panels of each said opposed side walls and said front and rear walls between a raised position in which said telescoping wall panels are nested together and an extended position in which said wall panels extend from said roof to the ground.

2. The enclosure of claim 1 in which said wall panels are each formed with a length and width dimension, said width dimension of said wall panels progressively increasing from said bottom wall panel to said top wall panel.

3. The enclosure of claim 1 in which said means for moving said wall panels comprises:

a motor;

first and second cables connected at opposite ends to said bottom wall panel of one of said side walls;

third and fourth cables connected at opposite ends to said bottom wall panel of the other of said side walls;

means operatively connecting said first, second, third and fourth cables to said motor;

said motor being operable to move said first, second, third and fourth cables in one direction to simultaneously raise said wall panels of said opposed side walls, and to move said cables in an opposite direction to simultaneously lower said wall panels of said opposed side walls said front and rear walls being movable with said side walls between said raised position and said extended position in response to operation of said motor.

4. The enclosure of claim 3 in which said means operatively connecting said first, second, third and fourth cables to said motor, comprises:

a reel rotatable by said motor in a clockwise and counterclockwise direction;

a junction block connected by a cable to said reel, said reel being effective to wind said cable thereon upon rotation in one of said clockwise and counterclockwise directions to move said junction block laterally in one direction, and said reel being effective to unwind said cable upon rotation in the other of said clockwise and counterclockwise directions to move said junction block in the opposite direction;

said first and second cables each extending through pulley means and being connected at one end to said bottom wall panel of one of said side walls and at the opposite end to said junction block for movement therewith, said third and fourth cables each extending through pulley means and being connected at one end to said bottom wall of the other of said side walls and at the opposite end to said junction block for movement therewith.

5. The enclosure of claim 1 in which said mounting means comprises a corner plate having a pair of perpendicular legs, one of said legs being connected to one end of a wall panel of said front or rear wall of said enclosure, and the other of said legs being connected to ssaid abutting end of a wall panel of one of said side walls of said enclosure.

* * * * *